US010758057B2

(12) United States Patent
He et al.

(10) Patent No.: US 10,758,057 B2
(45) Date of Patent: Sep. 1, 2020

(54) SINGLE MOTOR ADJUSTABLE MULTI-FUNCTION BED

(71) Applicant: I2 Mechanical Electrical CO., LTD, Jiaxing (CN)

(72) Inventors: Pengfei He, Jiaxing (CN); Guohai Tang, Jiaxing (CN); Long Li, Jiaxing (CN)

(73) Assignee: DewertOkin Technology Group Co., Ltd., Jiaxing, Zhejiang Province (CN)

( * ) Notice: Subject to any disclaimer, the term of this patent is extended or adjusted under 35 U.S.C. 154(b) by 434 days.

(21) Appl. No.: 15/698,401

(22) Filed: Sep. 7, 2017

(65) Prior Publication Data

US 2018/0132626 A1 May 17, 2018

(30) Foreign Application Priority Data

Nov. 17, 2016 (CN) ..... 2016 1 1012808

(51) Int. Cl.
*A47C 20/04* (2006.01)
*A47C 19/04* (2006.01)
(Continued)

(52) U.S. Cl.
CPC ..... *A47C 20/041* (2013.01); *A47C 17/17* (2013.01); *A47C 19/04* (2013.01); *A47C 20/04* (2013.01);
(Continued)

(58) Field of Classification Search
CPC ..... A47C 20/041; A47C 20/04; A47C 20/08; A47C 20/10; A47C 17/17; A47C 19/04; A61G 7/002; A61G 7/015; A61G 13/08
See application file for complete search history.

(56) References Cited

U.S. PATENT DOCUMENTS 5,438,723 A * 8/1995 Carroll ..... A47C 19/122 16/267
6,708,358 B2 * 3/2004 Hensley ..... A47C 20/041 5/613
(Continued)

FOREIGN PATENT DOCUMENTS

CN 202800842 U 3/2013
CN 204192103 U 3/2015
CN 107361946 A 11/2017

*Primary Examiner* — Robert G Santos
*Assistant Examiner* — Rahib T Zaman
(74) *Attorney, Agent, or Firm* — Wayne & Ken, LLC; Tony Hom

(57) ABSTRACT

The invention discloses a single motor adjustable multi-function bed, which comprises a fixed mechanism, a movable mechanism and a back panel. The fixed mechanism comprises a fixed frame, a movable rail is arranged symmetrically on both sides of the fixed frame, and one end of the fixed frame is provided with a first cross bar. The movable mechanism comprises a movable frame, a sliding part arranged symmetrically on both sides of the movable frame, a second cross bar arranged in the middle part of the movable frame, the movable rail engages with the sliding part, and the bottom of the back panel is connected with the first cross bar. And a driver is provided between the first cross bar and the second cross bar. The invention realizes the angle adjustment and the bed length adjustment function by the movable rail in conjunction with the sliding part.

8 Claims, 5 Drawing Sheets

(51) Int. Cl.

| | |
|---|---|
| ***A47C 17/17*** | (2006.01) |
| *A61G 7/002* | (2006.01) |
| *A47C 20/08* | (2006.01) |
| *A61G 13/08* | (2006.01) |
| *A61G 7/015* | (2006.01) |
| *A47C 20/10* | (2006.01) |

(52) U.S. Cl.
CPC ..... *A47C 20/08* (2013.01); *A47C 20/10* (2013.01); *A61G 7/002* (2013.01); *A61G 7/015* (2013.01); *A61G 13/08* (2013.01)

(56) References Cited

U.S. PATENT DOCUMENTS 8,615,828 B2 * 12/2013 Schermel ..... A47C 20/04 297/411.31
2005/0011005 A1 * 1/2005 Borda ..... A47C 19/04 5/412
2007/0089238 A1 * 4/2007 Kramer ..... A61G 7/015 5/618
2007/0163046 A1 * 7/2007 Eriksson ..... A47C 20/041 5/618
2008/0040857 A1 * 2/2008 Karmer, Jr. ..... A61G 7/012 5/616
2009/0178201 A1 * 7/2009 Lujan ..... A47C 20/027 5/618
2009/0211028 A1 * 8/2009 Richmond ..... A47C 20/041 5/618
2010/0186168 A1 * 7/2010 Harrison ..... A47C 20/041 5/616
2013/0019407 A1 * 1/2013 Sheppard ..... A47C 20/041 5/611
2014/0157515 A1 * 6/2014 Manson ..... A47C 17/162 5/13
2015/0067965 A1 * 3/2015 Xu ..... A47C 20/041 5/616

* cited by examiner

SINGLE MOTOR ADJUSTABLE MULTI-FUNCTION BED

FIELD OF THE INVENTION

The present invention relates to the field of electric furniture technology, and more specifically, to a single motor adjustable type multi-function bed which can automatically adjust the bed length and backrest angle.

BACKGROUND OF THE INVENTION

With the development of science and technology and the constant pursuit of quality of life, more and more products achieve automation, such as electric furniture, which is especially popular with everyone, electric furniture can improve people's ride comfort, people do not need to spend too much effort to get the ideal sitting position. The electric bed is a kind of electric adjustable furniture, the electric beds existing on the market mostly use multi-link mechanism for angle adjustment, however, multi-link mechanism is complex, and the stability of adjustment process is poor, which affects the comfort of the adjustment.

SUMMARY OF THE INVENTION

In order to solve the problems existing in the current technology, the present invention provides a single motor adjustable multi-function bed which is capable of automatically adjusting the length of the bed board and the backrest angle.

The technical proposal of the invention is as follows:

A single motor adjustable multi-function bed, comprising:

a fixed mechanism, a movable mechanism and a back panel;

the fixed mechanism comprises a fixed frame, at least a pair of movable rails are symmetrically arranged on both sides of the fixed frame; the fixed frame is provided with a first cross bar at one end near the end of the fixed frame; the movement mechanism comprises a movable frame, at least one pair of sliding parts symmetrically arranged in the movable frame, and a second cross bar arranged in the middle of the movable frame; each movable rail engages with each sliding part; a movable panel is arranged on the surface panel of the movable frame; the back panel and the movable panel are hinged by a hinge, and the bottom of the back panel is connected to the first cross bar through a connecting rod; a driver is provided between the first cross bar and the second cross bar; under action of the driver, the sliding part moves on the movable rail to drive the movable mechanism to move against the fixed mechanism, and under action of the hinge and the connecting rod, the back panel moves against the movable mechanism and the fixed mechanism, so that the function of the back panel as a backrest or a bed board is realized.

According to the single motor adjustable multi-function bed, the fixed frame is provided with a baffle at one end near the first cross bar, and the other end is provided with a connecting plate; two elastic connectors are symmetrically arranged at inner sides of one end of the two side plates near the first cross bar; the back panel is laid on the two elastic connectors as the bed board.

The movable rails are arranged directly on the side plates or fixed to the side plates by means of an auxiliary connector, or integrated on the side plates.

According to the single motor adjustable multi-function bed, the movable frame comprises a frame body; a stepped structure is provided at an outer end of the frame body; the height of a step is matched with the height of the connecting plate; the stepped structure moves against the connecting plate while the movable mechanism moves against the fixed mechanism; the length of the stepped structure is less than or equal to the length of the movable rail; after the movable mechanism slides outwardly against the fixed mechanism, a vertical edge of the stepped structure overlaps the inside of the connecting plate, an end part of one end away from the back panel overlaps the connecting plate when the back panel is as a backrest.

According to the single motor adjustable multi-function bed, the sliding part is a roller or a slider; the number of the movable rail corresponds to the sliding part; the sliding part is arranged symmetrically on the inner wall of both sides of the movable frame directly or indirectly through the auxiliary connector and is relatively free to rotate.

According to the single motor adjustable multi-function bed, the second cross bar is fixed to the middle of the frame body at both sides of the movable frame directly or through the auxiliary connector.

According to the single motor adjustable multi-function bed, wherein both ends of the connecting rod are connected to the back panel and the first cross bar directly or through the auxiliary connector, and the connecting rod rotates against the back panel and the first cross bar.

According to the single motor adjustable multi-function bed, both ends of the driver are connected respectively to the first cross bar and the middle of the second bar directly or through the auxiliary connector.

According to the single motor adjustable multi-function bed, both the movable rail and the slider are two pairs, and the movable rail is a straight rail.

Compared with the prior art, the advantageous effects of above technologies of the present invention are as follows:

1) According to the present invention, the movable mechanism can slide on the fixed mechanism by arranging fixed mechanism, movable mechanism and back panel. The back panel and the movable mechanism can be used as a bed board as customer needed, so that the length of the bed can be extended, or the back panel can be used as a backrest, and its angle can be adjusted easily and flexibly by the driver; the system can achieve the angle adjustment and bed length adjustment function through the movement of rails and sliding parts, the structure of the bed is stable in the adjustment process of the movement, which improves the comfort of the adjustment process; the system adjusts by a driver, so that the adjustment is more convenient and quick to get ideal adjustment angle.

2) The movement mechanism of the invention is connected with the back panel by a hinge, and the angle between the movement mechanism and the back panel is easily adjusted during the adjustment process.

3) According to the invention, when two elastic connectors are arranged symmetrically on the inner side of the two side plates of the fixed frame close to one end of the first cross bar, the back panel is laid on the two elastic connectors when the back panel is as the bed board, which improves the stability and comfort.

4) According to the present invention, a stepped structure is provided at the outer end of the main body of the movable frame, which improves the stability of movement and the compactness of the structure when the fixed mechanism moves against the movable mechanism.

Figure 1:
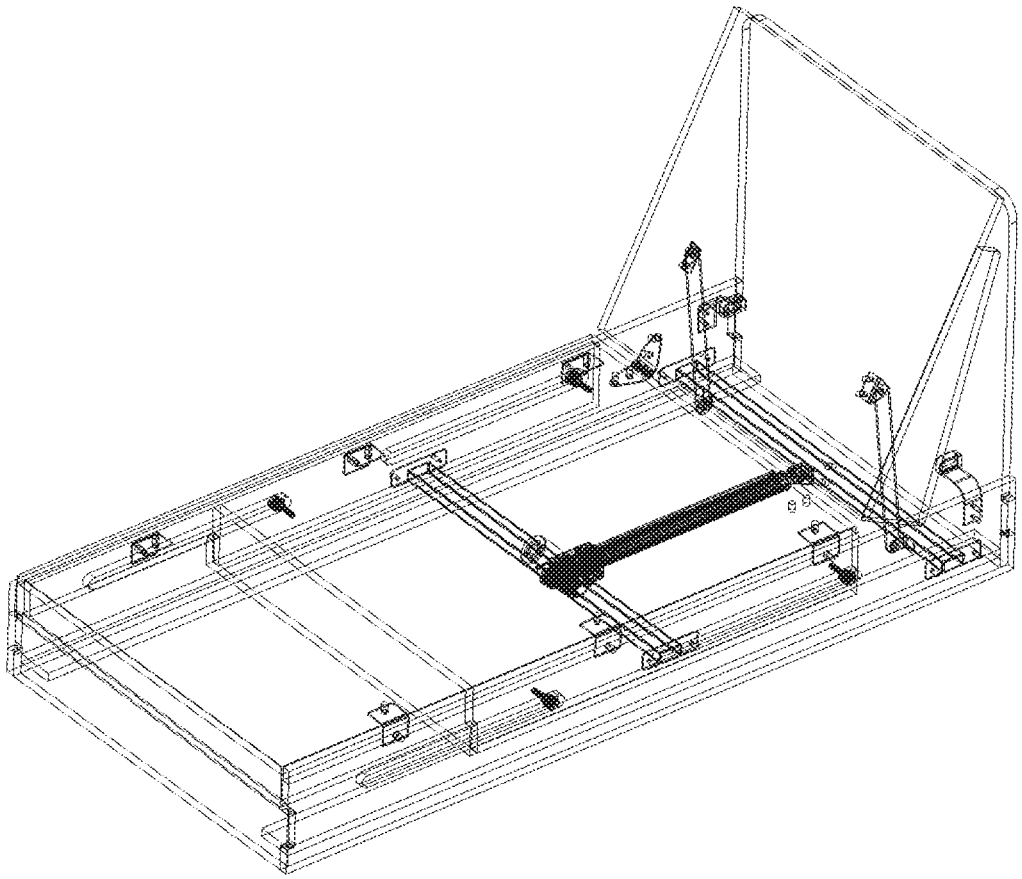
FIG. 1 is a structural schematic view of the present invention.
Figure 2:
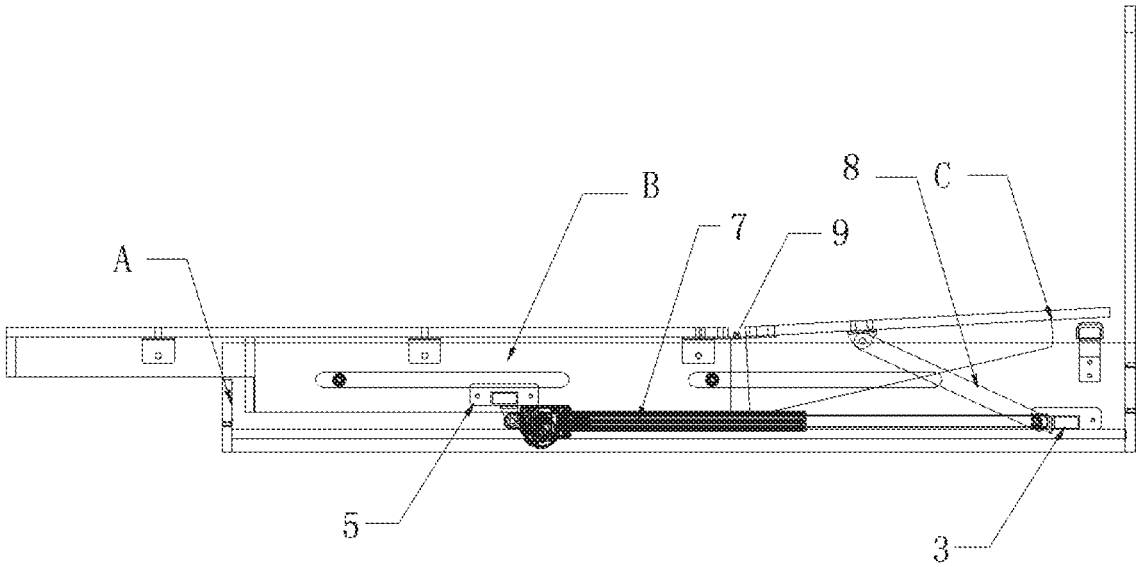
FIG. 2 is a structural schematic diagram of the first use state of the present invention.
Figure 3:
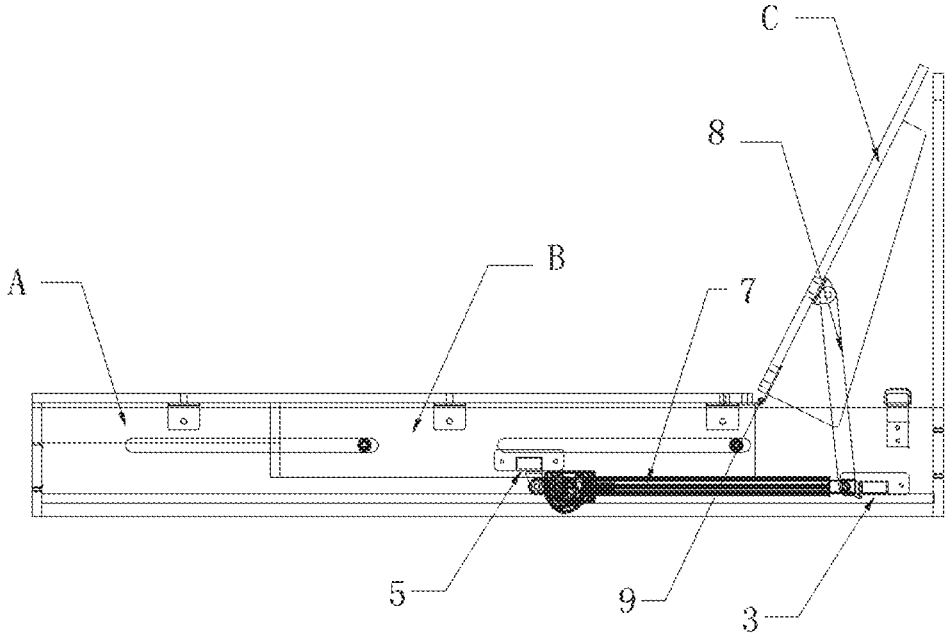
FIG. 3 is a structural schematic view of the second use state of the present invention.

In the figures, A—fixed mechanism, B—movement mechanism, C—back panel, 1—fixed frame, 101—baffle, 102—connecting plate, 103—side plate, 104—elastic connector, 2—movable rail, 3—first cross bar, 4—sliding part, 5—second cross bar, 6—movable frame, 601—movable panel, 61—frame body, 62—stepped structure, 7—driver, 8—connecting rod, 9—hinge.

DETAILED DESCRIPTION OF THE INVENTION

The present invention will now be described in further detail with reference to the drawings.

As shown in FIGS. 1-5, a single motor adjustable multi-function bed of the present invention comprises a fixed mechanism A, a movable mechanism B and a back panel C; the fixed mechanism A comprises a fixed frame 1, and at least one pair of movable rails 2 are arranged symmetrically to the end of the fixed frame 1, the first cross bar 3 is provided at one end near the end of the fixed frame 1. The movable mechanism B comprises a movable frame 6, at least one pair of sliding parts 4 arranged symmetrically on both sides of the movable frame 6, and the second cross bar 5 in the middle of the movable frame 6; the number of the movable rail 2 is corresponding to the sliding part 4 and they are engaged, the sliding part 4 can slide on the movable rail 2, and in the embodiment of the present invention, the movable rail 2 and the sliding members 4 are two pairs respectively, the movable rail 2 is a straight rail; the movable panel 601 is provided on the surface of the movable frame 6, and the back panel C and the movable panel 601 are hinged by the hinge 9. For the structural stability and the cost reduction, the number of the hinge 9 is generally 2-3, the bottom of the back panel C is connected to the first cross bar 3 through at least one connecting rod 8. The at least one connecting rod (8) is arranged in distance to each other and pivotally connected to the cross bar (3) so that at least one connecting rod (8) is arranged near an end range of the cross bar (3), thus bending stress applied thereon could be optimized. The driver 7 is provided between the first cross bar 3 and the second cross bar 5, preferably the driver is a motor; under the action of the driver 7, the slider 4 moves against the movable rail 2 to drive the movable mechanism B to move against the fixed mechanism A, and under the action of the hinge 9 and the connecting rod 8, the back panel C moves against the movable mechanism B and the fixed mechanism A, so that the function of the back panel C as a backrest or a bed board is realized.

Figure 4:
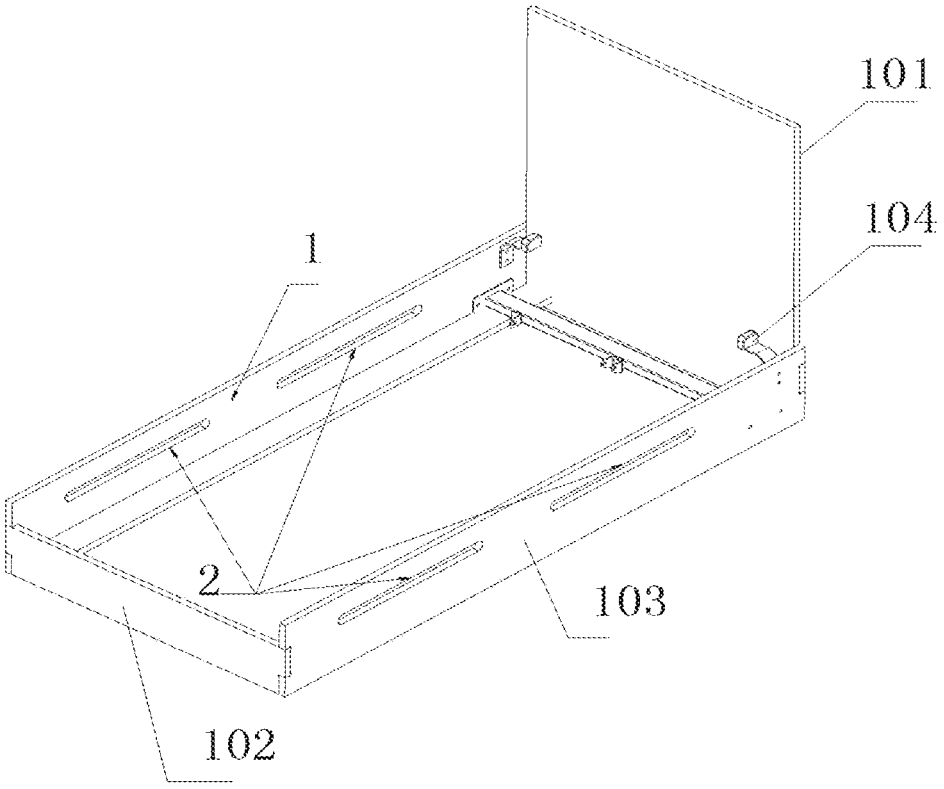
FIG. 4 is a structural schematic view of the fixed mechanism of the present invention.

As shown in FIG. 4, the fixed frame 1 is provided with a baffle 101 at one end near the first cross bar 3, and the other end is provided with a connecting plate 102; two elastic connectors 104 are symmetrically arranged at inner sides of one end of the two side plates 103 near the first cross bar 3; the back panel C is laid on the two elastic connectors 104 as a bed board. The elastic connector 104 is Z-type structure, one end is fixed to the side plate 103 and the other end is higher than the upper end face of the side plate 103, so that the back panel C is a bed board and the head of bed is slightly inclined. When lying down, the gravity of the human body presses the elastic connector 104, and the back panel C is flat with the surface of the movable mechanism B and the fixed mechanism A to improve the comfort.

Figure 5:
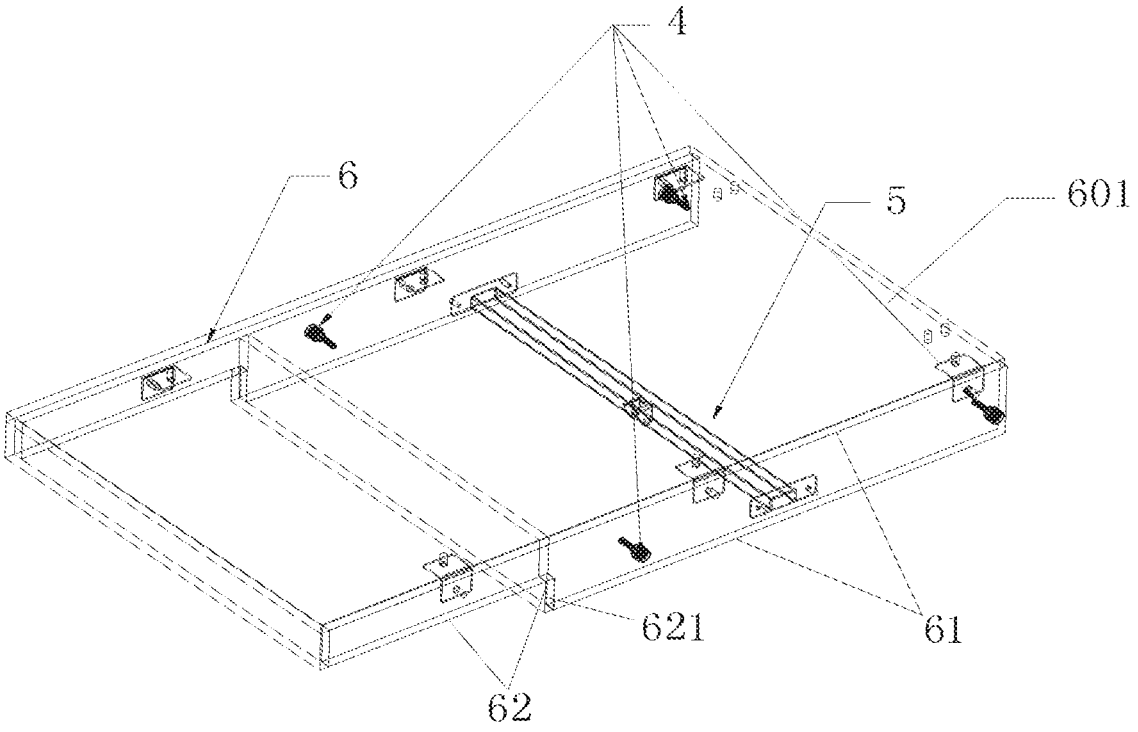
FIG. 5 is a structural schematic view of the movable mechanism of the present invention.

As shown in FIG. 5, the movable frame 6 comprises a frame body 61, a stepped structure 62 is arranged at the outer end of the frame body 61, the height of the step is matched with the height of the connecting plate 102, the stepped structure 62 can move against the connecting plate 102 while the movable mechanism B moves against the fixed mechanism A, the length of the stepped structure 62 is less than or equal to the length of the movable rail 2 and the movable mechanism B slides outwardly against the fixed mechanism A, the vertical edge 621 of the stepped structure 62 overlaps the inside of the connecting plate 102, an end part away from the movable frame 6 overlaps the connecting plate 102 when the back panel C is as a backrest.

The sliding part 4 of the present invention is a roller or a slider, the number of the movable rail 2 is corresponding to the sliding part 4, the sliding part 4 is arranged symmetrically on the inner wall of both sides of the movable frame 6 directly or through the auxiliary connector and is relatively free to rotate.

As shown in the figures, the components of the present invention may be connected directly or by means of an auxiliary connector, such as a movable rail 2 is arranged on the side plate 103 directly or fixed to the side plate 103 by an auxiliary connector, the auxiliary connector opens on the side plate 103, and the movable rail 2 is integrated on the side plate 103. In the embodiment of the present invention, the auxiliary connector may be metal and fixed to the side plate 103; the second cross bar 5 is located in the middle of the frame body 61 and is connected to the movable frame 6 directly or through the auxiliary connector. Both ends of the connecting rod 8 are connected to the back panel C and the first cross bar 3 directly or through the auxiliary connector. In the present invention, the back panel C and the first cross bar 3 are provided with U-shaped connecting members with two holes, both ends of the connecting rod 8 is provided with connecting holes, which are inserted into the U-shaped connecting members and connected fixedly by bolt inserting holes, and the connecting rod 8 can rotate against the back panel C and the first cross bar 3; both ends of the driver 7 are connected to the middle of the first cross bar 3 and the second cross bar 5, and in the present invention, the auxiliary connectors are metal. All the connecting members used in the present invention are common in the art, so it will not be repeated herein.

The operation of the present invention is as follows: the initial position is that: the back panel C is flat with the fixed mechanism A and the movable mechanism B, the connecting rod 8 is slightly horizontal, the telescopic rod of the driver 7 is in a contracted state, the stepped angle of the stepped structure at the outer end of the movable frame of the fixed mechanism A is in contact with the inner side of the connecting plate 102 of the fixed frame, the sliding part 4 of the movable mechanism B is located at the outer end of the movable rail 2 of the fixed mechanism, the bed board is in extended state; when the driver 7 operates, the telescopic rod of the driver 7 is extended so that the sliding part 4 moves inwardly on the movable rail 2, the movable mechanism B moves inwardly against the fixed mechanism A so as to drive the connecting rod 8 to rotate its two end connection points respectively, then the back panel C starts to move under the action of the connecting rod 8. Meanwhile, since the back panel C is hinged to the movable panel 601 of the movable mechanism B, the back panel C can be folded against the movable mechanism B so that the back panel C is gradually raised as a backrest, and the angle can be adjusted according to the length of the telescopic rod of the driver 7, thereby the process of adjusting the position and the angle thereof is completed.

What is claimed is:

1. A single motor adjustable multi-function bed, comprising:

a fixed mechanism (A), a movable mechanism (B) and a back panel (C);

wherein the fixed mechanism (A) comprises a fixed frame (1), and at least one pair of rails (2) symmetrically arranged on both sides of the fixed frame (1); the fixed frame (1) is provided with a first cross bar (3) at one end near an end of the fixed frame (1); the movement mechanism (B) comprises a movable frame (6), at least one pair of sliding parts (4) symmetrically arranged in the movable frame (6), and a second cross bar (5) connected with the movable frame (6) and arranged to a distance with the first cross bar (3);

the fixed frame (1) is provided with a baffle (101) at one end near the first cross bar (3), and the other end of the fixed frame is provided with a connecting plate (102); the movable frame (6) comprises a frame body (61); a stepped structure (62) is provided at an outer end of the frame body (61); the stepped structure (62) moves against the connecting plate (102) while the movable mechanism (B) moves against the fixed mechanism (A); a length of the stepped structure (62) is less than or equal to a length of the rails (2); after the movable mechanism (B) slides outwardly against the fixed mechanism (A), a vertical edge (621) of the stepped structure (62) overlaps an inside of the connecting plate (102); and after the movable mechanism (B) slides inwardly against the fixed mechanism (A), the back panel is raised to form a backrest, and an end of the stepped structure away from the back panel (C) aligns with the connecting plate (102);

the at least one pair of rails (2) engage with the at least one pair of sliding parts (4); a movable panel (601) is arranged on a surface panel of the movable frame (6); the back panel (C) and the movable panel (601) are connected with each other via a hinge, and the bottom of the back panel (C) is connected to the first cross bar (3) through at least one connecting rod (8); a driver (7) is provided between the first cross bar (3) and the second cross bar (5); under action of the driver (7), the sliding part (4) moves along the movable rail (2) to drive the movable mechanism (B) to move against the fixed mechanism (A), and under action of the hinge (9) and the connecting rod (8), the back panel (C) moves against the movable mechanism (B) and the fixed mechanism (A), so that the function of the back panel (C) as a backrest or a bed board is realized.

2. The single motor adjustable multi-function bed according to claim 1, wherein two elastic connectors (104) are symmetrically arranged at inner sides of one end of two side plates (103) near the first cross bar (3); the back panel (C) is laid on the two elastic connectors (104) as the bed board.

3. The single motor adjustable multi-function bed according to claim 2, wherein the rails (2) are arranged on the side plates (103) or integrated on the side plates (103).

4. The single motor adjustable multi-function bed according to claim 1, wherein the sliding part (4) is a roller or a slider; the number of the rails (2) corresponds to the sliding part (4); the sliding part (4) is arranged symmetrically on the inner wall of both sides of the movable frame (6) and is relatively free to rotate.

5. The single motor adjustable multi-function bed according to claim 1, wherein the second cross bar is fixed to the middle of the frame body at both sides of the movable frame.

6. The single motor adjustable multi-function bed according to claim 1, wherein both ends of the connecting rod (8) are connected to the back panel (C) and the first cross bar (3), and the connecting rod (8) rotates against the back panel (C) and the first cross bar (3).

7. The single motor adjustable multi-function bed according to claim 1, wherein both ends of the driver (7) are connected respectively to the first cross bar (3) and the middle of the second bar (5).

8. The single motor adjustable multi-function bed according to claim 1, wherein both the rails (2) and the sliding part (4) are two pairs, and the rails (2) are straight rails.

* * * * *